United States Patent [19]

Owen et al.

[11] Patent Number: 4,634,315

[45] Date of Patent: Jan. 6, 1987

[54] FORCED REFREEZING METHOD FOR THE FORMATION OF HIGH STRENGTH ICE STRUCTURES

[75] Inventors: Lawrence B. Owen; Sidney J. Green, both of Salt Lake City, Utah

[73] Assignee: Terra Tek, Inc., Salt Lake City, Utah

[21] Appl. No.: 768,053

[22] Filed: Aug. 22, 1985

[51] Int. Cl.[4] ..... E02D 17/00

[52] U.S. Cl. ..... 405/217; 62/260; 405/61

[58] Field of Search ..... 405/217, 61; 62/235, 62/66, 260

[56] References Cited

U.S. PATENT DOCUMENTS

| | | | |
|---|---|---|---|
| 1,053,443 | 2/1913 | Scott | 62/235 X |
| 3,658,124 | 4/1972 | Tippmann | 62/235 X |
| 4,048,808 | 9/1977 | Duthweiler | 405/217 |
| 4,192,630 | 3/1980 | Duthweiler | 405/217 |
| 4,245,930 | 1/1981 | Gefvert | 405/217 |
| 4,325,656 | 4/1982 | Bishop | 405/61 X |
| 4,513,583 | 4/1985 | Watt | 62/235 |
| 4,523,879 | 6/1985 | Finucane et al. | 405/217 |
| 4,551,985 | 11/1985 | Kovach | 62/235 |

*Primary Examiner*—Dennis L. Taylor

*Attorney, Agent, or Firm*—Beehler, Pavitt, Siegemund, Jagger, Martella & Dawes

[57] ABSTRACT

A method for accelerating construction of a load bearing ice island, formed by either sea water spraying or flooding techniques, of higher quality or in a shorter time or both than would otherwise be possible. The method involves forced refreezing of spray ice by application of a vertical stream of cold ambient air, as produced by a fan or other devices described, directly downward on the ice surface or by application of the downwardly directed air stream to an impounded mass of sea water. The specific application for the process is construction of improved load bearing structures as used in Arctic regions in support of offshore hydrocarbon exploration and production activities.

11 Claims, 6 Drawing Figures

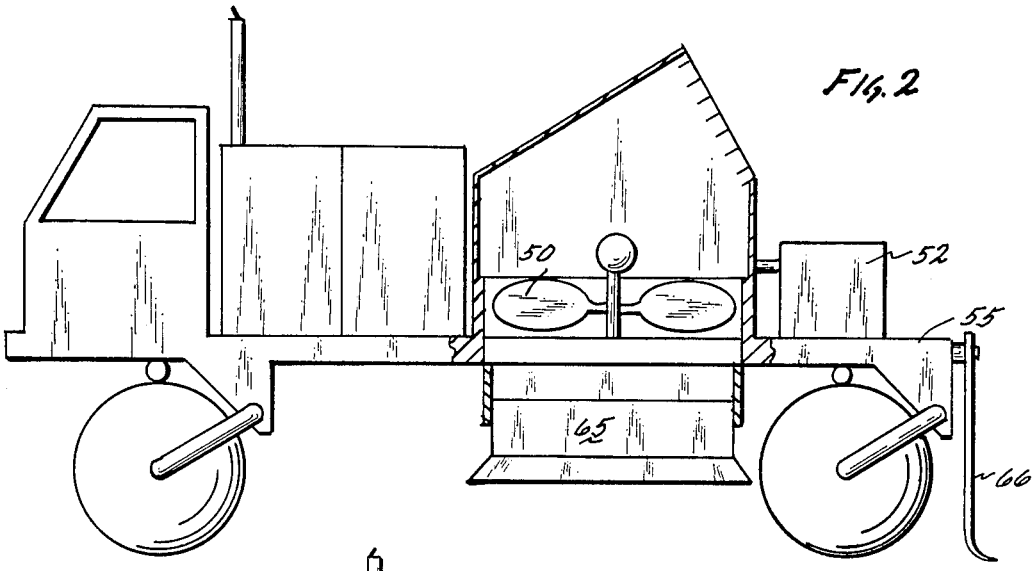
Fig. 2
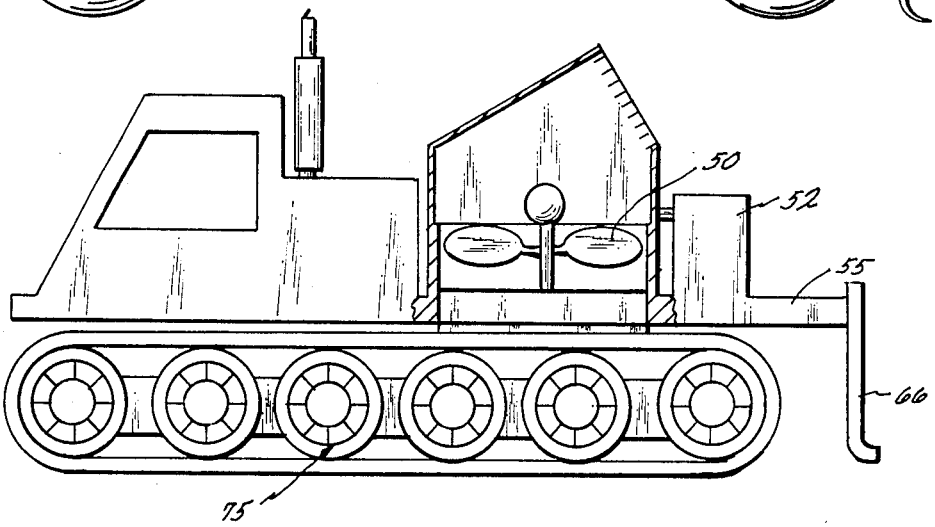
Fig. 3
Fig. 3a
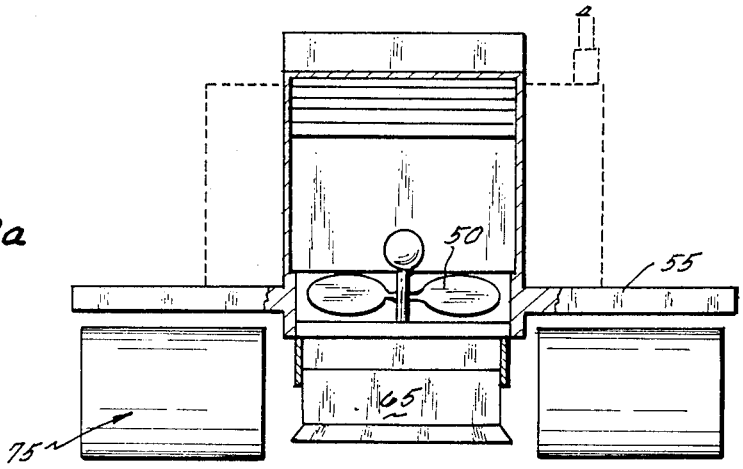

FORCED REFREEZING METHOD FOR THE FORMATION OF HIGH STRENGTH ICE STRUCTURES

BACKGROUND OF THE INVENTION

The present invention relates to an improved method for accelerating the freezing of ice, initially formed by the freezing of a sea water spray or impounded sea water, and more particularly to an improved method to form an engineered load-bearing ice structure of high quality and in a shorter time than normally could be obtained.

Rapid freezing of sea water is important in certain applications such as the construction of load-bearing ice structures in offshore Arctic regions where such structures are employed in conjunction with hydrocarbon exploration and production and in the construction of airfields, roads, camps and the like. In these applications, sea water is used exclusively as the aqueous medium and construction is usually started as soon as the ambient air temperature is sufficiently low to cause freezing of the sea water. It is economically advantageous to be able to cause the freezing of sea water to proceed as rapidly as possible so that load-bearing structures may be constructed in a relatively short period of time so as to extend to the maximum degree possible the utility of the manufactured structure.

A method commonly employed to form ice structures involves the propelling of sea water through the air as essentially a stream of sea water and over significant horizontal distances. The volume of the continuous stream may range up to 30,000 gallons per minute from a single nozzle used to propel the salt water over the needed distance. The air, by virtue of its low temperature with respect to the nominal freezing temperature of sea water (−1.6 to −2.0 degrees C depending on salinity), acts as a coolant. The formation of droplets and the interaction of the sea water stream/droplet spray with cooler air results in freezing of the projected droplet spray. The efficiency of freezing depends on efficient heat exchange between the sprayed droplets and air. Formation of water droplets and the size of the droplets ultimately governs freezing efficiency at any ambient air temperature less than the nominal freezing temperature of the sea water. At the spray nozzle, the bulk of the sea water is in the form of a solid stream of water having high momentum in order to cover the desired relatively large horizontal distance. In the vicinity of the nozzle, shear and turbulent forces along the periphery of the water stream initiate droplet breakup and segregation. Along the trajectory of the stream/droplet spray, wind forces and gravitational forces promote increasing droplet breakup and segregation. Maximum droplet breakup, in the absence of significant wind forces, occurs at the apogee of the stream trajectory. The surface tension of the sea water is the fundamental property which governs how soon discrete water droplets will form and their size distribution for any imposed set of ambient conditions.

Load-bearing ice structures are also commonly built by forming a berm or dike and then flooding the impounded area with sea water, the process being repeated, after freezing of the sea water, as necessary until a desired thickness of ice has formed. Ice structures which are used as the support unit for large drill rigs are themselves large. Construction may require one or more months. It is necessary, therefore, to accelerate the ice construction phase so as to allow maximum time for drilling activities prior to the onset of the Spring thaw. The more or less routine application of flooding-spraying technology in conjunction with offshore Arctic application is described in the prior art, U.S. Pat. No. 4,048,808 being a typical example.

In accordance with this invention, it has been discovered that the governing property of a high volume sea water stream is formation of water droplets varying in a size from 1 to about 3 mm in diameter. These droplets freeze in the form of hailstones, which are rounded or spherical masses of ice. The interior of the frozen droplets commonly contain liquid water of high salinity consistent with finite freezing rates and thermodynamic constraints that govern the freezing of saline solutions which have a true eutectic. Successful ice construction requires that the projected sprayed material which falls to the surface have a liquid content. Some droplets crush on impact releasing additional brine. The fallen material undergoes partial melting and then refreezing. Excess brine drains either away from the structure by virtue of its reduced freezing temperature, caused by partial evaporation during flight and by salt rejection that occurs simultaneously with freezing or remains entrained in the porosity of the spray ice. On impact with the ground, the brine is released and there is some partial melting of the frozen material. The newly formed slush then refreezes upon exposure to ambient temperature air. The refreezing which occurs after impact is the phenomena that is responsible for strength development in sprayed ice.

In ice construction, where the aim is to build a substantial load-bearing structure of a relatively large dimension, dry snow is undesirable and detrimental because snow contributes to a general weakening of the manufactured structure and snow does not possess the substantial strength of ice.

Sea water spray construction of ice islands is a complex process that includes several important phenomena which collectively control the properties of the manufactured structure. Sea water is usually applied as a spray. The freezing of the spray is controlled by ambient climactic conditions, the volume of spray and the size distribution of water droplets within the spray. Spray ice, which consists of a mixture of ice and brine and/or precipitated salt may, depending upon ambient temperature and wind conditions, partially remelt upon impact and then slowly refreeze. Typically, spray ice construction is a cyclic process where sea water is sprayed for a period of time and then spraying is terminated to allow refreezing of the sprayed surface. The cycle is then repeated as necessary to produce the desired structure. Internal structure of spray ice reflects the cyclic nature of its formation.

Manufactured ice consists of alternating layers of relatively hard ice immediately underlain by a much thicker layer of much softer material. The internal structure of an ice island is a direct reflection of the techniques used for its construction.

The basic methodology for construction of an ice island using sea water spraying techniques, consists of freezing a sea water spray by the cooling action of ambient temperature air on the spray. Since sea water must be sprayed in large volumes over considerable horizontal distances, nozzles are selected primarily for their throwing or spraying distance. This requirement places rather stringent controls of the size of water droplets which form in the spray. It is the discrete water droplets which ultimately freeze and fall to the ground.

As droplets form in the spray, they freeze in the form of spherical hailstones consisting of ice. The cores of many of the larger hailstones contain brine significantly more saline than the source sea water due to partial evaporation of sprayed sea water and salt rejection during the freezing process. Upon impact, some hailstones shatter releasing brine. Depending upon ambient temperatures, some free, unfrozen brine may also reach the ground unfrozen but concentrated by partial evaporation. The spray may reach heights above ground surface of two hundred (200) feet or more. Air temperature differences between the maximum height attained by the spray and ground level can also encourage partial remelting of spray ice.

The saline brine contacts previously sprayed and frozen material and causes partial melting of this material. The residue brine as a consequence of the partial remelting decreases in salinity. The newly formed slush is then slowly refrozen by the action of the ambient air. The slush refreezes from its surface downward. As the initial upper surface refreezes, lower levels of the slush are insulated from direct air contact and they freeze at a lower rate. As a result of this process, the sprayed ice consists of cyclic deposits of hard ice immediately underlain by softer material that was prevented from fully freezing. If spraying is stopped and then resumed at a later time, the newly fallen material will cause partial remelting of the previously frozen surface. Thus, the thickness of the hard ice surface is probably never as great as it was when originally formed just before resumption of spraying.

A thermal gradient exists from the sea water-ice interface to the ice-air interface. Thermistor arrays are usually buried in an ice island during construction, and temperature data derived from these devices graphically demonstrate the heat transfer phenomena. Thus, partial remelting of newly formed spray ice is also a reflection of heat transfer from the warmer sea water to the colder free ice surface.

The primary factors that govern spray ice construction can be summarized as follows: (1) the freezing dynamics of a sea water spray, and (2) the refreezing of spray ice.

In the past, researches have concentrated on understanding spray freezing phenomena. Essentially, no attention has been devoted to the problem of spray ice refreezing. The dominating importance of spray ice refreezing can be readily understood when it is noted that during a typical twenty four (24) hour period, sea water may be sprayed for ten (10) hours or less whereas the remainder of the twenty four (24) hour period is spent waiting for spray ice to refreeze. Any improvement resulting in a diminution of the time required to refreeze spray ice may have dramatic and significant impact on overall construction time and cost.

The time required to refreeze spray ice after a spraying period is the major factor that influences the time required to build an ice structure. It would be desirable, therefore, to provide improved and relatively simple methods for accelerating spray ice refreezing.

SUMMARY OF THE PRESENT INVENTION

In brief, the present invention focuses on acceleration of the formation of load bearing ice structures and more particularly to the acceleration of the refreezing of ice structures during their construction. In one form, the method of this invention involves use of a conveyance to move a ventilation fan across the newly deposited ice surface. Normally, refreezing of spray ice occurs by ambient air cooling. Wind blows cool air horizontally across the ice surface. However, the efficiency of the process is limited by thermal effects which retard heat heat transfer when the ice surface initially refreezes thereby insulating lower lying material from the direct cooling effects of ambient temperature air. Furthermore, wind velocity in the boundary layer adjacent to the ice surface may be a small fraction of wind forces at higher levels above the ice surface.

The method of the present invention involves forced refreezing by directing a vertical column of air downward on the ice surface with sufficient force to disrupt the surface material and, thereby, to cause cooling to a greater depth than would be otherwise possible. The roughened air-blown surface may then be resmoothed by a rake attached to the ventilation fan conveyance. Another approach involves mounting the fan directly on self-contained power units. Other methods for direction of air columns downward in a spray ice surface include use of helicopters of hydrofoils operated over the desired area or tracked vehicles or use of winches and cranes to support or transport any one of a number of different well known devices to move a vertical air column across the spray ice surface.

Ice construction using flooding techniques is effective and routinely practiced in Arctic regions because it is possible to freeze a shallow impounded mass of sea water. Cooling occurs at the water-air interface. An intrinsic property of water is the attainment of maximum density at a temperature slightly above its freezing temperature. This property allows for more uniform cooling of a large impounded water mass.

The forced refreezing method can, therefore, equally be applied to the accelerated freezing of impounded sea water.

Application of the forced refreezing method, whether applied to the refreezing of spray ice or to the accelerated freezing of impounded sea water, will significantly improve the mechanical properties of the ice structure, where improvemnt in load-bearing strength and shear resistance is desirable. This improvement is obtained because refreezing of spray ice or accelerated freezing of impounded sea water, occurs over a greater depth range, by virtue of the forced refreezing of the downward directed air column which contacts the spray ice or impounded sea water over a greater vertical depth than could be obtained normally by the action of wind blowing more or less horizontal with respect to the local ground surface.

In accordance with the present invention, enhanced cooling or forced refreezing of spray ice or forced freezing of impounded sea water can be accomplished by use of a large downward-facing fan that is moved over the freshly sprayed or flooded surface to decrease the heat transfer resistance between the ambient temperature and surface temperature. There are two important factors that work together to increase the freezing speed considerably. These two factors are that the heat transfer coefficient is much greater in stagnation flow, compared to parallel flow; and, in a related aspect, the blowing arrangement ensures that the cold far-field temperature is brought in closer proximity of the surface.

Virtually any technique for moving fan, or other source of downwardly directed frigid air, across a surface may be employed. By the present invention, it is the movement of large volumes of cold ambient temperature air downward against a layer of freshly prepared spray ice or impounded sea water which is important and for the purpose of more quickly and completely freezing or refreezing the surface material. The air stream produced by the fan can be controlled so that spray ice or impounded sea water may be cooled over a greater depth than is possible by natural cooling due to wind movement horizontally across the spray ice or impounded sea water surface. This more efficient cooling will lead to more complete freezing and refreezing and, thereby, production of a stronger structure in a shorter time.

In Arctic regions, it is common practice to employ wheeled and tracked vehicles in conjunction with ice island and other types of construction activities. Modification of these devices by addition of the ventilation fan is practical, feasible, and by means disclosed herein, beneficial in providing for more rapid and complete freezing and refreezing of spray ice and impounded sea water. Application of the methods disclosed herein will, therefore, significantly shorten the time normally required to fabricate an ice structure and, therefore, reduce construction costs. Furthermore, application of the disclosed methods will result in ice structures having greater inherent load-bearing capacity and resistance to shear, by virtue of more complete freezing, than could otherwise be reasonably expected by application of what is generally recognized to be standard and accepted ice structure construction practice.

An obvious implication of the forced refreezing method is its extension to ice construction involving primarily the preparation of offshore ice roads, camps, air fields, parking ramps and the like.

It is apparent from the foregoing brief description that the present invention offers many advantages over the prior art methodology. These and other advantages and other objects are made more clearly apparent from a consideration of the several forms in which the present invention may be practiced. Such forms are described and forms of the various apparatus which may be used in the practice of this invention are illustrated in the present specification. The forms described in detail are for the purpose of illustrating the general principles of the present invention; but it is to be understood that such detailed description is not to be taken in a limiting sense.

BRIEF DESCRIPTION OF THE DRAWINGS

FIG. 2 is a diagrammatic view of another form of apparatus which may be used in the practice of the present invention;

FIG. 3 is a diagrammatic view of yet another form of apparatus which may be used in the practice of this invention; and FIG. 3*a* is a diagrammatic view, in section, of the device illustrated in FIG. 3.

DETAILED DESCRIPTION OF THE INVENTION

Figure 1:
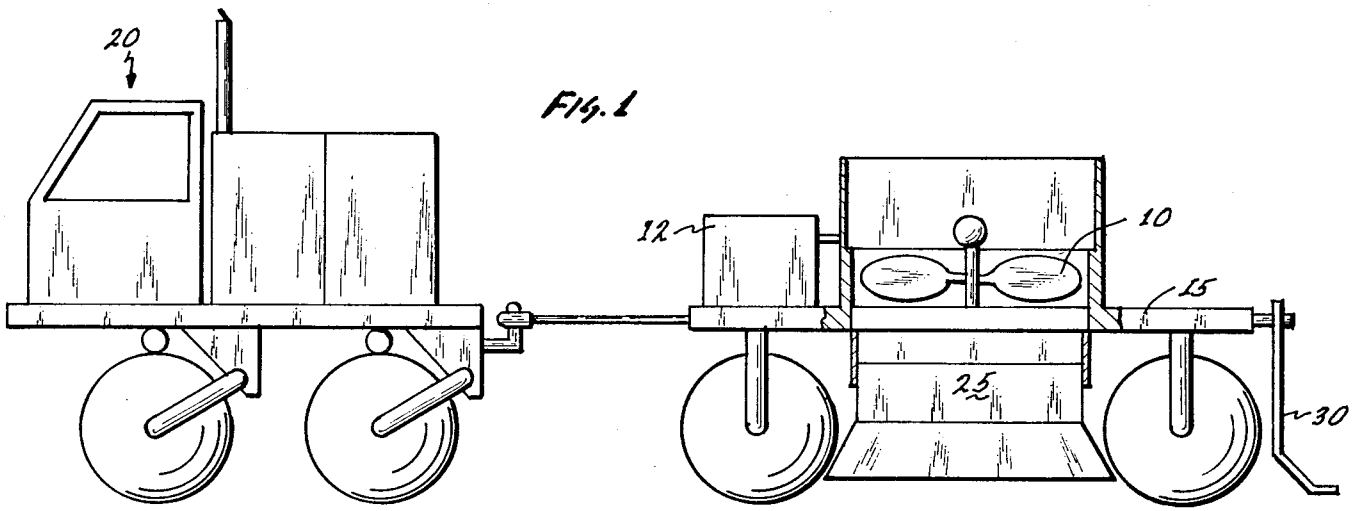
FIG. 1 is a diagrammatic view of one form of apparatus which may be used to practice the present invention.

In accordance with the present invention, load-bearing ice structures may be fabricated from frozen sea water and in those geographic areas and at those times of the year in which the ambient air temperature is below about minus one degree C. The fabrication of ice structures, in accordance with the present invention, also contemplates the continued maintenance of a site in those regions amenable to construction of ice structures. Thus, for example, roads or aircraft runways and the like may be partially completed by conventional construction and completed or processed in accordance with the present invention.

There are two basic modes of practicing the improved ice construction methodology of the present invention. In one mode, a spraying technique, as described, may be used. In the other a berm is formed to impound sea water and thereafter the construction proceeds in accordance with this invention.

Ice construction applications involving the freezing of sea water sprays benefit from a reduction in the time required to refreeze partially melted spray ice. In similar fashion, more rapid freezing of impounded sea water would be desirable and beneficial. Accelerated rates of freezing of spray ice and impounded sea water can be obtained by directing a controlled column of frigid ambient air vertically downward against the surface to be frozen. The air temperature should be at least below about minus one degree C. in order to effect freezing of sea water.

As mentioned, in the use of spraying techniques, the spraying operation, in addition to providing for the formation of ice particles, by the freezing of water drops, results in the formation of a slush ice which is of a salinity greater than the normal salinity of sea water. The slush ice is, in effect, a residue having a salinity somewhat higher than that of the sea water initially frozen from the droplet spray. As noted, the refreezing of this slush ice is responsible for the development of strength in the formation spray formed ice structures. In the case of spay ice construction, it is this refreezing which adds to the time of construction and which is needed in order to develop the desired strength of the load-bearing ice structure.

By the present invention, an initial ice structure is formed. For the purposes of this invention, the initial ice structure is that initially formed at the start of the construction and which, in effect, forms the base upon which the final ice structure is constructed. Overall, the process is cyclical, involving spraying, freezing and refreezing, and spraying etc., a cycle that is repeated until the structure is completed.

By the present invention, the freezing and refreezing portion of the cycle is shortened and the nature of the frozen product, in terms of its load carrying qualities, is improved over prior practices. To effect this improvement, it is necessary to effect reasonably rapid freezing of the slush ice or impounded ice, in order to achieve a depth of frozen ice which enhances the loadcarrying ability of the finished ice structure.

By the present invention, this is accomplished by the formation of an initial ice structure, either by spraying or impounding procedures, followed by directing downwardly towards the surface of the initial ice structure a controlled column of frigid ambient air. Since the surface of the initial ice structure possesses sufficient integrity to support weight, vehicles may be used to transport equipment intended to generate a downwardly vertically directed column of air. Thus, the methodology involves traversing the initial ice structure while directing the column of air against the surface of the ice structure. in general the entire surface of the initial ice structure is traversed, although this may not be necessary for those portions intended not to be significant load-bearing regions of the completed ice structure.

After the first pass, additional sea water is sprayed or added to the impounded area and the process is repeated. In those instances in which the surface of the initial ice structure is such that it is undesirable to use ground vehicles, a helicopter may be used in which case the main rotor down wash forms the controlled column of air which is directed against the ice surface.

Figure 1A:
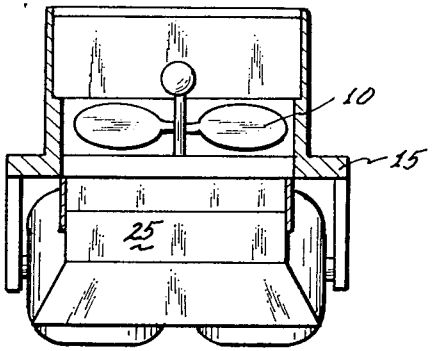
FIG. 1*a* is a diagrammatic view, in section, of the device illustrated in FIG. 1.

As an example of the type of vehicles which may be used, reference to the drawings, FIGS. 1 through 3, which illustrate typical land vehicles of the type used in the Arctic region. As illustrated in FIGS. 1 and 1*a*, a ventilation fan 10 and its associated speed control and electric power generator 12 are mounted on a wheeled platform 15 that is towed behind a wheeled primary power unit 20. The power unit 20 may, for example be a unit known commercially as a ROLL-E-GONE power unit.

The air rate is adjusted so as to disturb the spray ice surface with air penetration into the spray ice or, alternatively, into a layer of impounded sea water. Disruption and dispersion of spray ice is minimized by placement of a shroud 25 about the fan which also serves to channel the column of frigid air downwardly. Disrupted and refrozen spray ice may be converted to a smooth surface by passage of the rake 30 located at the end of the fan platform 15. In use, the vehicle traverses the initial ice structure while the fan blows a column of frigid air downwardly towards the surface. One pass is usually sufficient, depending upon the capacity of the fan and the rate of travel. If necessary a partial or added pass may be made, as needed. Thereafter, spraying is continued or additional sea water is added to the impounded area formed by the berm.

Figure 2A:
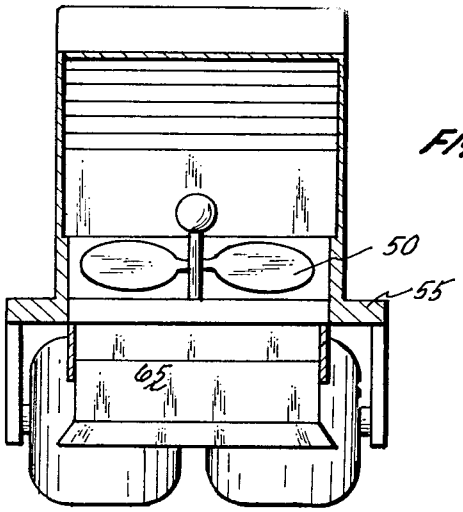
FIG. 2*a* is a diagrammatic view, in section, of the device illustrated in FIG. 2.

Alternatively, the fan conveyance of FIGS. 2 and 2*a* may be employed, in which cases, the various components, such as the fan 50 and the generator 52 are mounted on the bed 55 which is combined into a single power unit. The shroud 65 is located as illustrated, with the rake 66 mounted on the end of the bed. The unit illustrated in FIGS. 3 and 3*a* is similar to that of FIGS. 2 and 2*a* except that the vehicle is a tracked vehicle 75, as shown.

In use, a layer of spray ice of six (6) to twelve (12) inches thickness is formed. Sea water spraying would then cease for the period required to freeze the deposited material by passage of the fan. Sea water spraying or flooding would then resume and the cycle of spraying or flooding followed by forced refreezing would continue as necessary until an ice structure of desired size were built.

It will be apparent from the above detailed disclosure that various modifications may be made, based on the above detailed disclosure, and it is understood that such modifications as will be apparent to those skilled in the art are to be considered within the scope of the present invention as set forth in the appended claims. So, for example, the passage of a helicopter over an impounded body of sea water would be but another instance of the application of the present invention. Similarly, the passage of a hydrofoil or hovercraft, which is a vehicle that moves on a cushion of air, over a spray ice surface or a body of impounded sea water, can be seen to be but another embodiment of the forced refreezing method.

We claim:

1. An improved method for the construction of load-bearing ice structures including ice platforms and grounded ice islands and the like wherein the ambient air is sufficiently cold to effect freezing of sea water and wherein the structure is constructed from sea water, comprising the steps of:

initially forming an initial ice structure from sea water by spraying or impounding the sea water, thereafter directing downwardly towards the upper surface of said initial ice structure a controlled column of ambient air having a temperature sufficiently low to freeze sea water and water having a salinity greater than sea water such that at least a portion of the entire surface is sequentially exposed to said column of air to effect freezing or refreezing thereof, and continuing to apply sea water to said ice structure followed by the step of directing cold ambient air to the surface thereof until said ice structure is completed.

2. The improved method as set forth in claim 1 wherein said ice structure is formed by propelling sea water over a horizontal distance and at the location in which said ice structure is to be formed.

3. The improved method as set forth in claim 1 wherein a berm is constructed to impound said sea water.

4. The improved method as set forth in claim 1 wherein the temperature of said ambient air is below about minus one degree C.

5. The improved method as set forth in claim 1 further including the step of raking said surface after said column of air has been directed thereto.

6. The improved method as set forth in claim 1 wherein said column of air is directed vertically downward and in a confined and controlled column and is caused to traverse essentially the entire surface of the ice structure being constructed.

7. The improved method as set forth in claim 2 wherein after said spraying operation there is formed a sea water residue having a salinity higher than that of the starting sea water and wherein said column of air is effective to refreeze the relatively high salinity sea water residue formed as a result of spraying.

8. The method as set forth in claim 1 wherein said step of directing said column of air includes traversing at least a portion of the ice structure being constructed with a vehicle to cause a column of air to be directed downward towards the surface of said ice structure.

9. The improved method as set forth in claim 8 in which said vehicle travels in contact with the surface of the ice structure being constructed.

10. An improved method for the formation of load-bearing ice structures including ice platforms and the like wherein the ambient air is sufficiently cold to effect freezing of sea water and wherein the structure is constructed from sea water, comprising the steps of:

initially forming an initial ice structure from sea water by spraying sea water horizontally over a distance and in the location of the construction of the ice structure, said initial ice structure including at least a portion of its surface which is composed of slush ice made up of frozen sea water and sea water residue having a salinity greater than that of the sea water, directing downwardly towards the upper surface of said ice structure a controlled column of ambient air having a temperature sufficient low to freeze sea water to effect refreezing of said slush ice to effect formation of a frozen ice surface, and continuing the cycles of applying sea water to said surface followed by the step of directing cold ambient air to said surface until said ice structure is completed.

11. An improved method of forming a load-bearing ice structure from an impounded mass of sea water, comprising the steps of:

forming a berm, filling said berm to a predetermined depth with sea water to effect freezing thereof by contact with ambient air, directing downwardly towards said frozen surface a controlled column of ambient air to effect more rapid freezing of the impounded sea water, and repeating the steps of filling and directing said column of air until said ice structure is completed.

* * * * *